US010469925B2

(12) United States Patent
Fukuhara et al.

(10) Patent No.: US 10,469,925 B2
(45) Date of Patent: Nov. 5, 2019

(54) SPEAKER DEVICE

(71) Applicant: Panasonic Intellectual Property Management Co., Ltd., Osaka (JP)

(72) Inventors: Suemei Fukuhara, Osaka (JP); Kazuki Honda, Osaka (JP); Takafumi Yuasa, Osaka (JP); Churo Sato, Osaka (JP); Ippei Kiyama, Hyogo (JP); Satoshi Takayama, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/074,790

(22) PCT Filed: Feb. 21, 2017

(86) PCT No.: PCT/JP2017/006261
§ 371 (c)(1),
(2) Date: Aug. 2, 2018

(87) PCT Pub. No.: WO2017/154548
PCT Pub. Date: Sep. 14, 2017

(65) Prior Publication Data

US 2019/0045285 A1 Feb. 7, 2019

(30) Foreign Application Priority Data

Nov. 25, 2016 (JP) ..... 2016-229497

(51) Int. Cl.
*H04R 1/02* (2006.01)
*H04R 1/28* (2006.01)
(Continued)

(52) U.S. Cl.
CPC ..... *H04R 1/025* (2013.01); *H04R 1/24* (2013.01); *H04R 1/2896* (2013.01); *H04R 9/06* (2013.01); *H04R 1/26* (2013.01); *H04R 9/025* (2013.01)

(58) Field of Classification Search
CPC ..... H04R 9/06; H04R 1/24; H04R 1/025
See application file for complete search history.

(56) References Cited

U.S. PATENT DOCUMENTS

2001/0028724 A1 10/2001 Kowaki et al.
2004/0208336 A1* 10/2004 Hamada ..... H04R 1/025 381/386

(Continued)

FOREIGN PATENT DOCUMENTS

EP 1509061 A2 2/2005
JP 63-290493 11/1988

(Continued)

OTHER PUBLICATIONS

International Search Report of PCT application No. PCT/JP2017/006261 dated Apr. 25, 2017.

(Continued)

*Primary Examiner* — Regina N Holder
(74) *Attorney, Agent, or Firm* — McDermott Will & Emery LLP

(57) ABSTRACT

A speaker device includes: a loudspeaker including a diaphragm and a field portion disposed rearwardly of the diaphragm; and a cabinet accommodating the field portion. The loudspeaker also includes a mounting member with which the loudspeaker is mounted to the cabinet, and a mounting plane of the mounting member includes a center of gravity of the loudspeaker.

11 Claims, 13 Drawing Sheets

(51) Int. Cl.

| | |
|---|---|
| ***H04R 1/24*** | (2006.01) |
| ***H04R 9/06*** | (2006.01) |
| *H04R 1/26* | (2006.01) |
| *H04R 9/02* | (2006.01) |

(56) References Cited

U.S. PATENT DOCUMENTS

| | | | | |
|---|---|---|---|---|
| 2006/0104472 | A1 | 5/2006 | Abe et al. | |
| 2009/0211840 | A1* | 8/2009 | Jiang ..... | H04R 1/02 181/199 |
| 2009/0304224 | A1 | 12/2009 | Abe et al. | |

FOREIGN PATENT DOCUMENTS

| | | |
|---|---|---|
| JP | 6-245287 | 9/1994 |
| JP | 2001-285974 | 10/2001 |
| JP | 2005-064796 | 3/2005 |
| JP | 2006-148665 | 6/2006 |
| JP | 2007-288688 A | 11/2007 |

OTHER PUBLICATIONS

The Extended European Search Report dated Feb. 18, 2019 for the related European Patent Application No. 17762891.4.

* cited by examiner

SPEAKER DEVICE

This application is a U.S. national stage application of the PCT International Application No. PCT/JP2017/006261 filed on Feb. 21, 2017, which claims the benefit of foreign priority of Japanese patent applications No. 2016-046364 filed on Mar. 9, 2016 and No. 2016-229497 filed on Nov. 252016, the contents all of which are incorporated herein by reference.

TECHNICAL FIELD

The present disclosure relates to a speaker device.

BACKGROUND ART

A general loudspeaker includes a vibration system having a diaphragm, a voice coil, and a frame, and a field portion having a yoke, a magnet, and a plate.

When such a loudspeaker is mounted in a cabinet for formation of a speaker device, the frame is generally fixed to an outer shell of the cabinet at a periphery of a sound emitting side of the loudspeaker.

There are many cases where the loudspeaker has its center of gravity located in the field portion because the field portion of the loudspeaker has the yoke and the magnet that weigh more than the diaphragm does.

As such, weight of the loudspeaker mounted in the cabinet is not well-balanced in the general speaker device, and when the loudspeaker is driven, there are cases where vibration of the diaphragm is transmitted to the cabinet through the frame, thus causing distortion in sound reproduced by the loudspeaker.

PTL 1 discloses a speaker device. In this speaker device, a field portion is disposed inwardly of a frame for adjustment of weight balance of a loudspeaker (namely, a position of a center of gravity of the loudspeaker), and a plane at which the loudspeaker is mounted is aligned with the center of gravity of the loudspeaker.

CITATION LIST

Patent Literature

PTL 1: Unexamined Japanese Patent Publication No. 2006-148665

SUMMARY

In the loudspeaker disclosed in PTL 1, the field portion is disposed nearer to a sound emitting side than a diaphragm is, so that there are cases where the field portion causes distortion in sound that is reproduced by the diaphragm.

The present disclosure provides a speaker device that is capable of suppressing distortion in reproduced sound.

The speaker device of the present disclosure includes: a loudspeaker including a diaphragm and a field portion disposed rearwardly of the diaphragm; and a cabinet accommodating the field portion. The loudspeaker further includes a mounting member with which the loudspeaker is mounted to the cabinet, and a mounting plane of the mounting member includes a center of gravity of the loudspeaker.

The speaker device of the present disclosure suppresses distortion in reproduced sound, thus being capable of reproducing clear sound.

DESCRIPTION OF EMBODIMENTS

Figure 1:
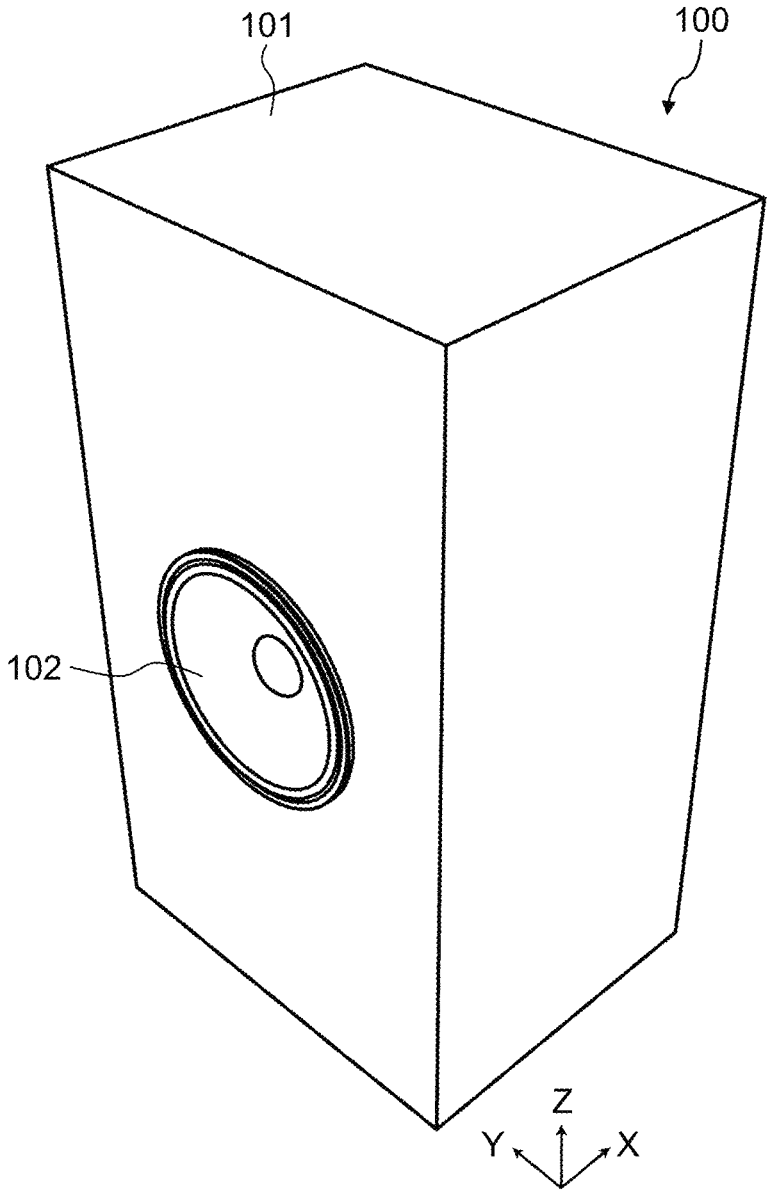
FIG. 1 is a perspective view schematically illustrating an example of external appearance of a speaker device according to a first exemplary embodiment.

Exemplary embodiments of a speaker device according to the present disclosure are described with reference to the drawings. It is to be noted that the following exemplary embodiments are merely illustrative of the speaker device of the present disclosure. The scope of the present disclosure is defined by the recitations in the claims with the following exemplary embodiments used as references and thus is not limited to the following exemplary embodiments only. As such, among constituent elements in the following exemplary embodiments, constituent elements not recited in the independent claim that indicates the most generic concept of the present disclosure are not necessarily essential for achievement of the object of the present disclosure but are described for the preferred embodiments.

It is also to be noted that the accompanying drawings and the following description are provided for those skilled in the art to fully understand the present disclosure and are not intended to limit the subject matter as described in the claims.

The drawings are not necessarily exact illustrations, but schematic views in which emphasis, omission, and proportion adjustment are made as required for illustration of the present disclosure, and these drawings may have shapes, positional relationships, and proportions that differ from actual shapes, actual positional relationships, and actual proportions. In the drawings, those substantially identical constituent elements have the same reference marks, and descriptions of those constituent elements may be omitted or simplified.

First Exemplary Embodiment

With reference to FIGS. 1 to 5, a description is hereinafter provided of speaker device 100 according to a first exemplary embodiment. In the present exemplary embodiment, a face provided with loudspeaker 102 is referred to as a front face of speaker device 100, while a face opposite from the face provided with loudspeaker 102 is referred to as a back face of speaker device 100. Relative proximity to the front face is described as "forward", while relative proximity to the back face is described as "rearward" or "backward". In the respective drawings, three axes including an X-axis, a Y-axis, and a Z-axis are shown. The X-axis indicates a depth direction (a front-back direction) of speaker device 100. The Y-axis indicates a direction parallel to a side (e.g., a short side) of the front face of speaker device 100. The Z-axis indicates a direction parallel to another side (e.g., a long side) of the front face of speaker device 100. These axes and directions are shown only for convenience and do not limit the present disclosure at all.

[1-1. Structure] FIG. 1 is a perspective view schematically illustrating an example of an external appearance of speaker device 100 according to the first exemplary embodiment.

As shown in FIG. 1, speaker device 100 includes cabinet 101 and loudspeaker 102.

Figure 2:
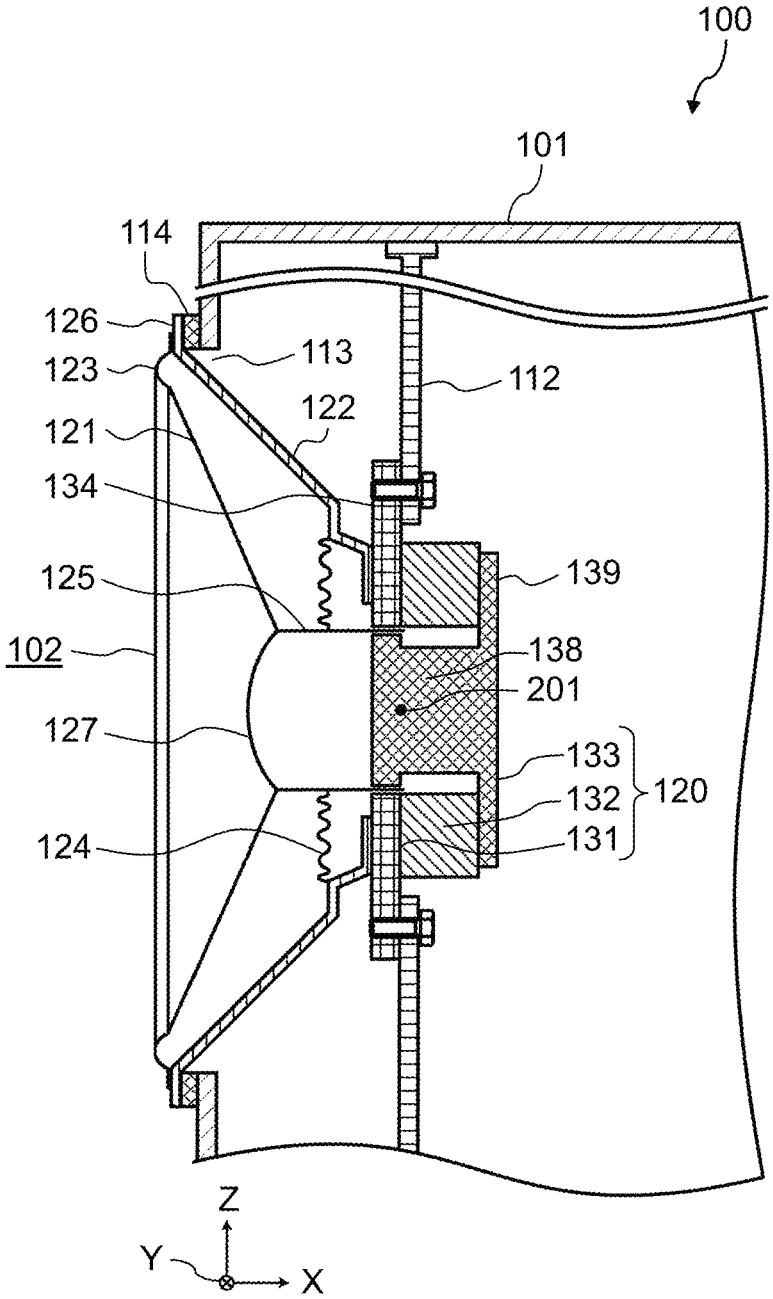
FIG. 2 is a sectional view schematically illustrating a structural example including a loudspeaker and its proximity in the speaker device according to the first exemplary embodiment.

FIG. 2 is a sectional view schematically illustrating a structural example including loudspeaker 102 and its proximity in speaker device 100 according to the first exemplary embodiment.

Loudspeaker 102 is an electroacoustic transducer that reproduces sound based on an input signal. As shown in FIG. 2, loudspeaker 102 includes diaphragm 121, frame 122, edge 123, damper 124, voice coil body 125, and field portion 120.

Diaphragm 121 is a member that vibrates air by shifting back and forth (along the X-axis in the drawing) relative to its neutral position based on an electrical signal, thereby generating sound. In the example shown in the present exemplary embodiment, diaphragm 121 has the shape of a cone (truncated cone) and is provided with a hole in its center. Diaphragm 121 is mounted with voice coil body 125 at its inner periphery (hole edge). Loudspeaker 102 has, as a sound emitting side, a side that passes an outer periphery of cone-shaped diaphragm 121.

Examples of a material for diaphragm 121 include, but not particularly limited to, paper, polymeric resin, and metal. Center cap 127 is mounted to close the hole provided in the center of diaphragm 121.

Frame 122 is a structural member that holds the outer periphery of diaphragm 121 in a predetermined place. Frame 122 includes ring-shaped annulus 126 disposed to encircle the outer periphery of diaphragm 121. Annulus 126 is disposed on the sound emitting side of loudspeaker 102. In the example shown in the present exemplary embodiment, frame 122 has such a truncated cone shape that its diameter gradually decreases heading rearward (toward a back face of loudspeaker 102 or in a positive direction along the X-axis) from annulus 126. An area including an (inner-periphery-side) end opposite from annulus 126 of frame 122 is fixed to field portion 120. A given example of a material for frame 122 and a given example of a method of forming frame 122 respectively can be, but not particularly limited to, a metal plate including iron as a principal component and press working of the metal plate.

Edge 123 is an annular member connecting the outer periphery of diaphragm 121 and annulus 126 of frame 122. Edge 123 has flexibility to allow for vibration of diaphragm 121 relative to frame 122 and has resilience to restore diaphragm 121 to the neutral position when loudspeaker 102 is undriven. In the example shown in the present exemplary embodiment, edge 123 is molded of resin and is of substantially semicircular section.

Damper 124 is a thin annular member that is disposed between annulus 126 and field portion 120 on the X-axis to connect frame 122 and voice coil body 125. Damper 124 is disposed in substantially parallel relation with the sound emitting side of loudspeaker 102. Damper 124 has flexibility to allow for vibration of voice coil body 125 relative to frame 122 and has resilience to restore voice coil body 125 to the neutral position when loudspeaker 102 is undriven.

Figure 3:
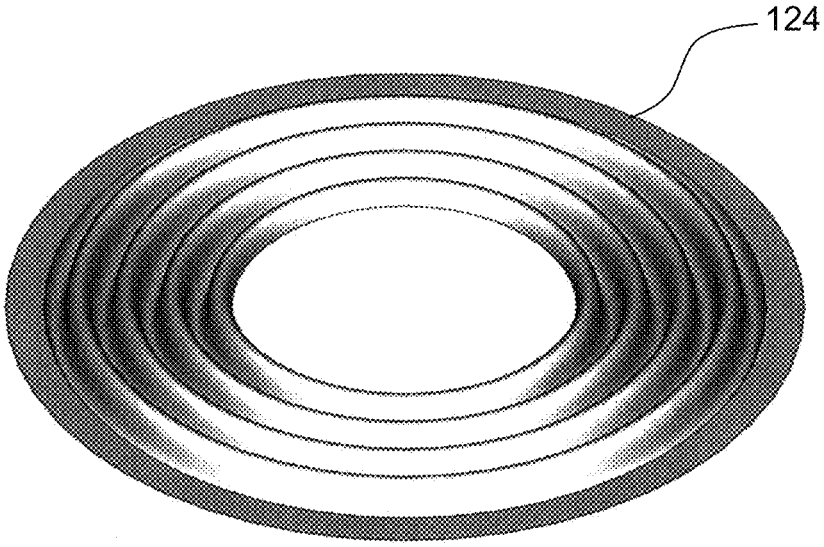
FIG. 3 is a perspective view schematically illustrating an example of a damper included in the speaker device according to the first exemplary embodiment.

FIG. 3 is a perspective view schematically illustrating an example of damper 124 included in speaker device 100 according to the first exemplary embodiment. In the example shown in the present exemplary embodiment, damper 124 is formed to have a shape of concentric circular corrugations as shown in FIG. 3. Consequently, damper 124 has the flexibility and the resilience. The flexibility of damper 124 is ensured because when voice coil body 125 vibrates relative to frame 122, the corrugations of damper 124 stretch accordingly, changing from their original shape along with an increasing relative distance between an inner and an outer periphery of damper 124. The resilience of damper 124 is ensured because when voice coil body 125 stops vibrating, the corrugations of damper 124 restore their original shape.

Although not particularly limited, a material that is used for damper 124 includes woven fabric as a base material and thermoplastic resin as a binder in the example shown in the present exemplary embodiment. Specifically, damper 124 of the present exemplary embodiment can be made by impregnating the woven fabric with liquid thermoplastic resin and thereafter cooling the woven fabric.

Damper 124 thus made has the wider elastic region and the higher resilience in comparison with cases where thermosetting resin is used as a binder. Consequently, even when damper 124 is deformed significantly, the binder resin does not, for example, craze or fissure easily in damper 124, making damper 124 hard to break. Damper 124 can maintain its constant stiffness for a long time from a time when damper 124 is formed, so that initial sound quality can be maintained for a long time with a resonance frequency decline suppressed in speaker device 100.

Voice coil body 125 is a member that has one end disposed in magnetic gap 136 (refer to FIG. 4) that is formed in field portion 120, and another end joined to diaphragm 121. Voice coil body 125 functions to generate a magnetic flux corresponding to an incoming electrical signal for interaction with magnet 132, whereby diaphragm 121 is vibrated. In the example shown in the present exemplary embodiment, voice coil body 125 includes a cylindrical bobbin and a coil wound around the bobbin.

Figure 4:
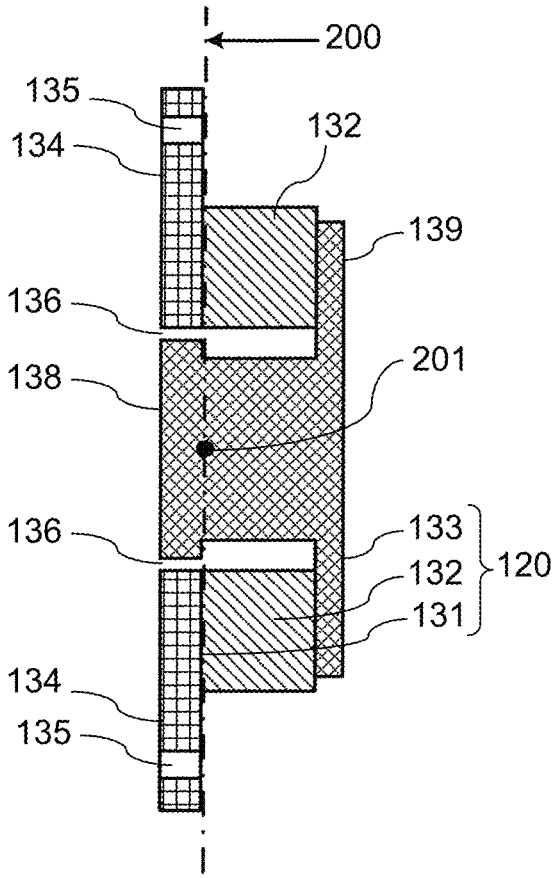
FIG. 4 is a sectional view schematically illustrating a structural example of a field portion included in the speaker device according to the first exemplary embodiment.

FIG. 4 is a sectional view schematically illustrating a structural example of field portion 120 included in speaker device 100 according to the first exemplary embodiment.

Field portion 120 is a member that forms a magnetic circuit that vibrates diaphragm 121 by means of voice coil body 125. Field portion 120 is disposed rearwardly of diaphragm 121, namely, on a side that is opposite from the sound emitting side of loudspeaker 102 across diaphragm 121. In the example shown in the present exemplary embodiment, field portion 120 includes top plate 131, magnet 132, and yoke 133.

Top plate 131 is an annular plate member, and its inner periphery is a portion for forming magnetic gap 136. A magnetic material is used as a material for top plate 131 to focus the magnetic flux on magnetic gap 136. In the example shown in the present exemplary embodiment, top plate 131 also functions as mounting member 134 with which loudspeaker 102 is mounted to cabinet 101. Mounting plane 200 of mounting member 134 configured to include center of gravity 201 of loudspeaker 102. As shown in FIG. 4, mounting plane 200 of mounting member 134 in the present exemplary embodiment is a plane that passes along a back face of mounting member 134. In the present exemplary embodiment, mounting member 134 is integral with top plate 131 while being flush with top plate 131 at mounting plane 200.

With top plate 131 having the above structure, there is no need for preparation of mounting member 134 as a separate component, so that loudspeaker 102 can have a reduced parts count. Moreover, top plate 131 integral with mounting member 134 is a disk-shaped member provided with a through hole in its center, thus enabling easy machining and a reduced manufacturing cost. Furthermore, mounting top plate 131 to cabinet 101 means simultaneous mounting of mounting member 134 to cabinet 101, so that a simplified process of manufacturing speaker device 100 can be achieved.

In the example shown in the present exemplary embodiment, mounting member 134 is a part projecting outward from an outer edge of magnet 132. For the purpose of facilitating mounting work of loudspeaker 102, which is carried out rearwardly of fixed part 112, mounting member 134 is provided with internal threads 135.

Magnet 132 is of annular shape, is disposed to encircle a central part of yoke 133, and is fixed firmly to top plate 131. Magnet 132 has a top-plate-end surface magnetized to have one of a south pole and a north pole, and an opposite surface magnetized to have the other pole.

Yoke 133 is a member that is made of a magnetic material to form magnetic gap 136 of cylindrical shape with an inner peripheral surface of top plate 131. Yoke 133 guides magnetic force of magnet 132 to magnetic gap 136. In the example shown in the present exemplary embodiment, yoke 133 includes cylindrical part 138 and disk 139 that is disposed coaxially and integrally with cylindrical part 138 at one end (a rearward end) of cylindrical part 138. As shown in FIG. 4, yoke 133 is formed to have a T-shaped section. A surface on the other end side (forward) of cylindrical part 138 of yoke 133 is formed to be flush with a forward surface of top plate 131, and magnetic gap 136 is formed between an outer peripheral surface of the other end of cylindrical part 138 and the inner peripheral surface of top plate 131. When disposed, cylindrical part 138 is inserted through a hole of annular magnet 132 from a rear of magnet 132, and disk 139 makes contact with the rearward surface of magnet 132.

Figure 5:
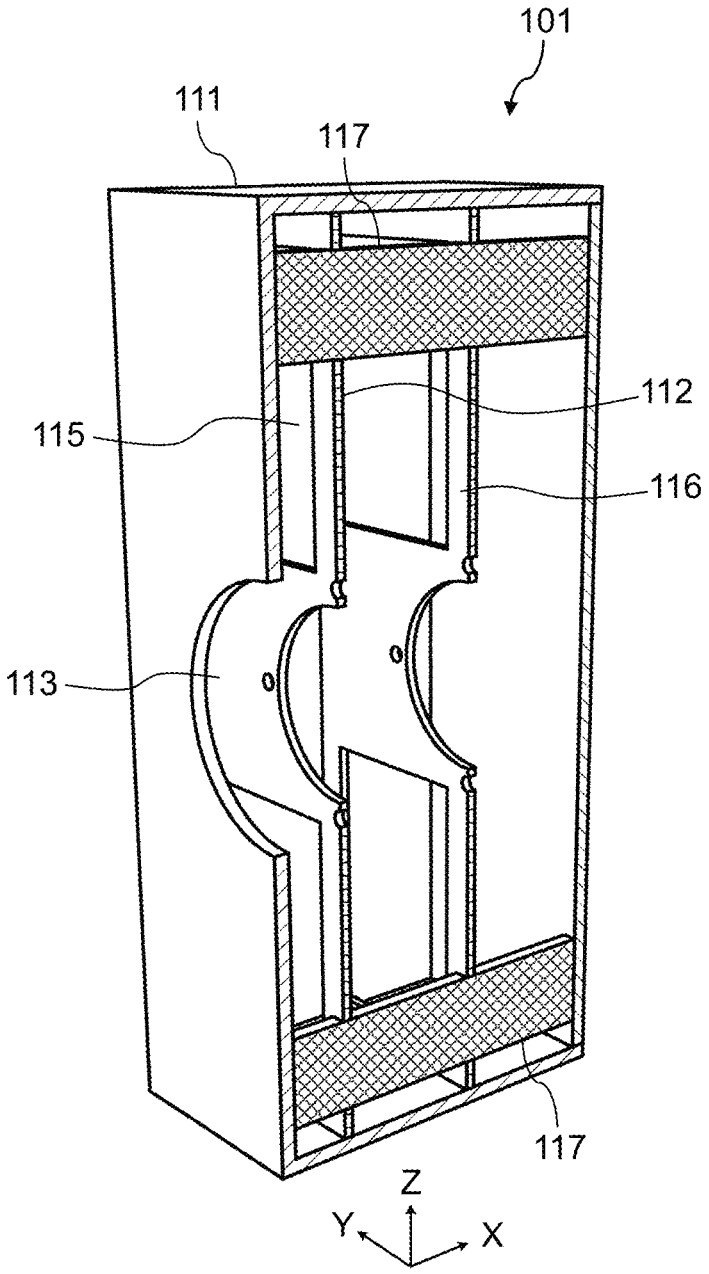
FIG. 5 is a perspective sectional view schematically illustrating a structural example of a cabinet of the speaker device according to the first exemplary embodiment.

FIG. 5 is a perspective sectional view schematically illustrating a structural example of cabinet 101 of speaker device 100 according to the first exemplary embodiment.

As shown in FIGS. 2 and 5, cabinet 101 is a housing that accommodates field portion 120 disposed on the side opposite from the sound emitting side across diaphragm 121 (or rearwardly of diaphragm 121). Cabinet 101 includes outer shell 111 and fixed part 112.

Outer shell 111 is a member in which antiphase sound that is reproduced rearwardly of diaphragm 121 of loudspeaker 102 is confined or utilized.

In a conventional technique (not shown), an outer shell of a cabinet has a function of fixing a loudspeaker. On the other hand, outer shell 111 of cabinet 101 according to the present disclosure has not a function of directly fixing loudspeaker 102.

In the example shown in the present exemplary embodiment, outer shell 111 of cabinet 101 is provided with, in its front wall, through hole 113 through which loudspeaker 102 is inserted to be disposed.

As shown in FIG. 2, a diameter of through hole 113 is about the same as an inner diameter of annulus 126 of frame 122. Sealing member 114 is provided in a clearance between a periphery of through hole 113 and annulus 126 of frame 122. Sealing member 114 has flexibility to seal the clearance.

Sealing member 114 is an annular member. By shutting a rear side of diaphragm 121 in outer shell 111, sealing member 114 can prevent antiphase sound from leaking out through the clearance between loudspeaker 102 and outer shell 111. Sealing member 114 can also damp vibration that might be transmitted from loudspeaker 102 to outer shell 111 during sound reproduction by absorbing the vibration of loudspeaker 102.

Fixed part 112 is disposed in cabinet 101 and is a member to which mounting member 134 is fixed for disposing loudspeaker 102 in a predetermined place. In the example shown in the present exemplary embodiment, loudspeaker 102 being in the predetermined place means that loudspeaker 102 is disposed in a position inserted through through hole 113 of cabinet 101. With loudspeaker 102 being mounted in the predetermined place in cabinet 101, fixed part 112 and mounting member 134 are in contact with each other at mounting plane 200.

Thus, loudspeaker 102 is fixed to cabinet 101 at mounting plane 200 that includes center of gravity 201 of loudspeaker 102. In this way, vibration of loudspeaker 102 can be prevented from being transmitted to fixed part 112 and outer shell 111 during sound reproduction, and accordingly, speaker device 100 can reproduce clear sound with distortion suppressed in sound reproduced by loudspeaker 102.

As shown in FIG. 5, inside cabinet 101, fixed part 112 is fixed to cabinet 101 while stretching from a ceiling to a bottom face of cabinet 101 as well as stretching from one side face to an opposite side face of cabinet 101 in the example shown in the present exemplary embodiment. This means that fixed part 112 also functions as a member with which cabinet 101 is reinforced. Fixed part 112 is provided with, in a respective plurality of positions, large passage holes 115 that allow passage of sound.

In the example shown in the present exemplary embodiment, reinforcing plate 116 of the same shape as fixed part 112 is mounted in cabinet 101 rearwardly of fixed part 112. Moreover, two beams 117 are respectively disposed at an upper and a lower position in cabinet 101, passing through fixed part 112 and reinforcing plate 116. Such a structure enables cabinet 101 and fixed part 112 to have improved structural strengths, respectively. As such, fixed part 112 and entire outer shell 111 of speaker device 100 can reliably receive vibration of loudspeaker 102 during sound reproduction, and clear sound can be emitted with sound distortion suppressed.

[1-2. Effects and Others]

As described above, the speaker device according to the present exemplary embodiment includes: a loudspeaker including a diaphragm and a field portion disposed rearwardly of the diaphragm; and a cabinet accommodating the field portion. In the speaker device, the loudspeaker further includes a mounting member with which the loudspeaker is mounted to the cabinet, and a mounting plane of the mounting member includes a center of gravity of the loudspeaker.

It is to be noted that speaker device 100 is an example of the speaker device. Diaphragm 121 is an example of the diaphragm. Field portion 120 is an example of the field portion. Loudspeaker 102 is an example of the loudspeaker. Cabinet 101 is an example of the cabinet. Mounting member 134 is an example of the mounting member. Center of gravity 201 is an example of the center of gravity of the loudspeaker. Mounting plane 200 is an example of the mounting plane.

In thus formed speaker device 100, for example, loudspeaker 102 is fixed to cabinet 101 at mounting plane 200 that includes the center of gravity of loudspeaker 102, so that weight of loudspeaker 102 is well-balanced in comparison with a conventional technique in which a frame is fixed to an outer shell of a cabinet at a periphery of a sound emitting side of a loudspeaker when the loudspeaker is mounted to the cabinet. Thus, in comparison with the conventional technique, transmission of vibration of loudspeaker 102 to cabinet 101 can be more suppressed during sound reproduction in speaker device 100. In speaker device 100, field portion 120 is disposed rearwardly of diaphragm 121, so that field portion 120 is unlikely to cause a phenomenon such as distortion in sound that is reproduced by diaphragm 121. As such, speaker device 100 can achieve reproduction of clear sound with distortion suppressed in sound reproduced by loudspeaker 102.

In the speaker device, the cabinet may include a fixed part to which the mounting member for the loudspeaker is fixed. The fixed part is disposed in the cabinet.

It is to be noted that fixed part 112 is an example of the fixed part.

In thus formed speaker device 100, for example, loudspeaker 102 can be fixed to mounting member 134 disposed in cabinet 101 and thus can be fixed to cabinet 101 at mounting plane 200 including the center of gravity of loudspeaker 102. Thus, vibration of loudspeaker 102 can be prevented from being transmitted to cabinet 101 during sound reproduction in speaker device 100, and accordingly, clear sound can be reproduced with distortion suppressed in sound reproduced by loudspeaker 102.

In the speaker device, the cabinet may include a through hole through which the loudspeaker is disposed. The cabinet may further include a sealing member that has flexibility to seal between a periphery of the through hole and an outer peripheral part of the loudspeaker.

It is to be noted that through hole 113 is an example of the through hole. Sealing member 114 is an example of the sealing member.

In thus formed speaker device 100, for example, sealing member 114 can prevent antiphase sound from leaking out through the clearance between loudspeaker 102 and through hole 113 during sound reproduction by loudspeaker 102 disposed in through hole 113. Sealing member 114 can also damp vibration that might be transmitted from loudspeaker 102 to cabinet 101 (outer shell 111) during sound reproduction by absorbing the vibration of loudspeaker 102.

In the speaker device, the mounting member may be integral with a top plate of the loudspeaker. Moreover, the mounting member may be flush with the top plate at the mounting plane.

It is to be noted that top plate 131 is an example of the top plate.

With thus formed speaker device 100, for example, there is no need for preparation of mounting member 134 and top plate 131 as separate components, so that loudspeaker 102 can have the reduced parts count. Moreover, by mounting top plate 131 to cabinet 101, mounting member 134 is mounted to cabinet 101 simultaneously, so that the simplified process of manufacturing speaker device 100 can be achieved.

(Other Examples of First Exemplary Embodiment)

The first exemplary embodiment has been described above as being illustrative of the technique disclosed in the present application. However, the above exemplary embodiment is not restrictive of the present disclosure. For example, other exemplary embodiments that are realized by combining the constituent elements of choice that are described in this description or omitting some of the constituent elements may also be exemplary embodiments of the present disclosure. Also included in the present disclosure are modifications that are obtained by making to the above exemplary embodiment various changes that may be conceived of by those skilled in the art without departing from the spirit of the present disclosure, that is to say, the meaning of the recitations in the claims.

Accordingly, other structural examples of the first exemplary embodiment are hereinafter described.

Figure 6:
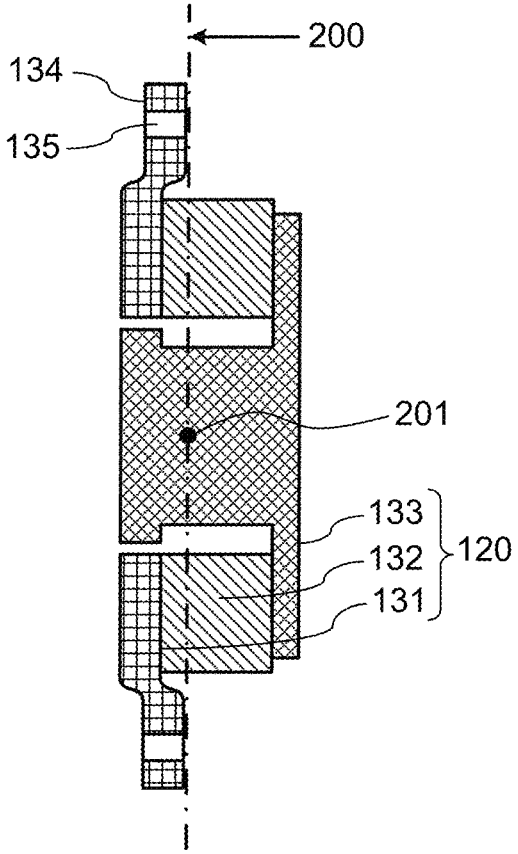
FIG. 6 is a sectional view schematically illustrating a structural example of a mounting member in another example of the first exemplary embodiment.

FIG. 6 is a sectional view schematically illustrating a structural example of mounting member 134 in another example of the first exemplary embodiment. In the structural example of the first exemplary embodiment of FIG. 4, top plate 131 is flush with mounting member 134; however, the present disclosure is not limited to this structure. For example, top plate 131 may not be flush with mounting member 134 as shown in FIG. 6. This structure enables easy alignment between mounting plane 200 and the center of gravity of loudspeaker 102 in a design stage of loudspeaker 102.

Figure 7:
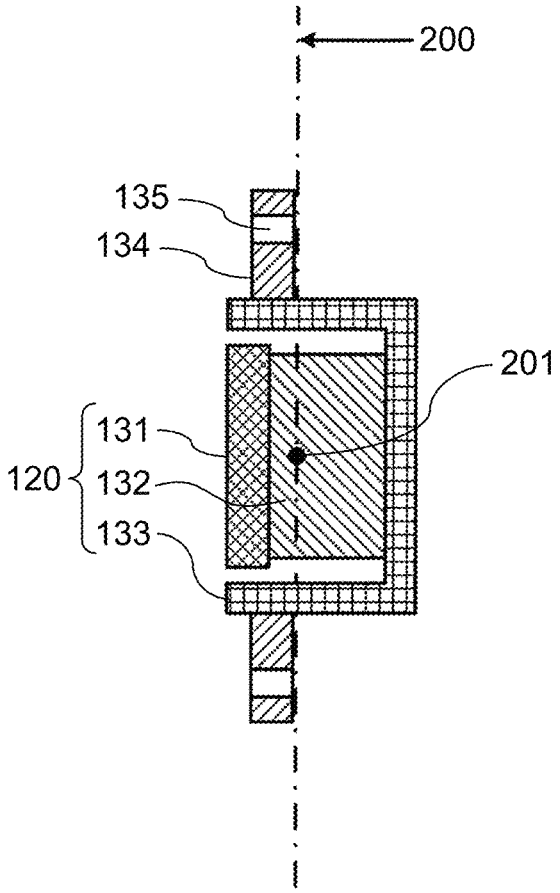
FIG. 7 is a sectional view schematically illustrating a structural example including a field portion and a mounting member in another example of the first exemplary embodiment.

FIG. 7 is a sectional view schematically illustrating a structural example including field portion 120 and mounting member 134 in another example of the first exemplary embodiment. As shown in FIG. 7, field portion 120 may, for example, include a magnetic circuit with an inner magnet, and as a member separate from field portion 120, mounting member 134 may be mounted to yoke 133.

Second Exemplary Embodiment

A description is provided next of speaker device 100A according to a second exemplary embodiment. While speaker device 100A includes a plurality of loudspeakers 102, loudspeakers 102 are each supported by substantially the same structure as loudspeaker 102 of speaker device 100 described in the first exemplary embodiment. In the following description, it is to be noted that constituent elements that have substantially the same actions, functions, shapes, mechanisms, or structures as the constituent elements described in the first exemplary embodiment have the same reference marks, and their description may be omitted. The following description is centered on those different from the first exemplary embodiment, and descriptions of matters described in the first exemplary embodiment and descriptions of the same contents as those of the first exemplary embodiment may be omitted. In the present exemplary embodiment, "forward", "backward", an X-axis, a Y-axis, and a Z-axis are defined similarly to those in the first exemplary embodiment.

[2-1. Structure]

Figure 8:
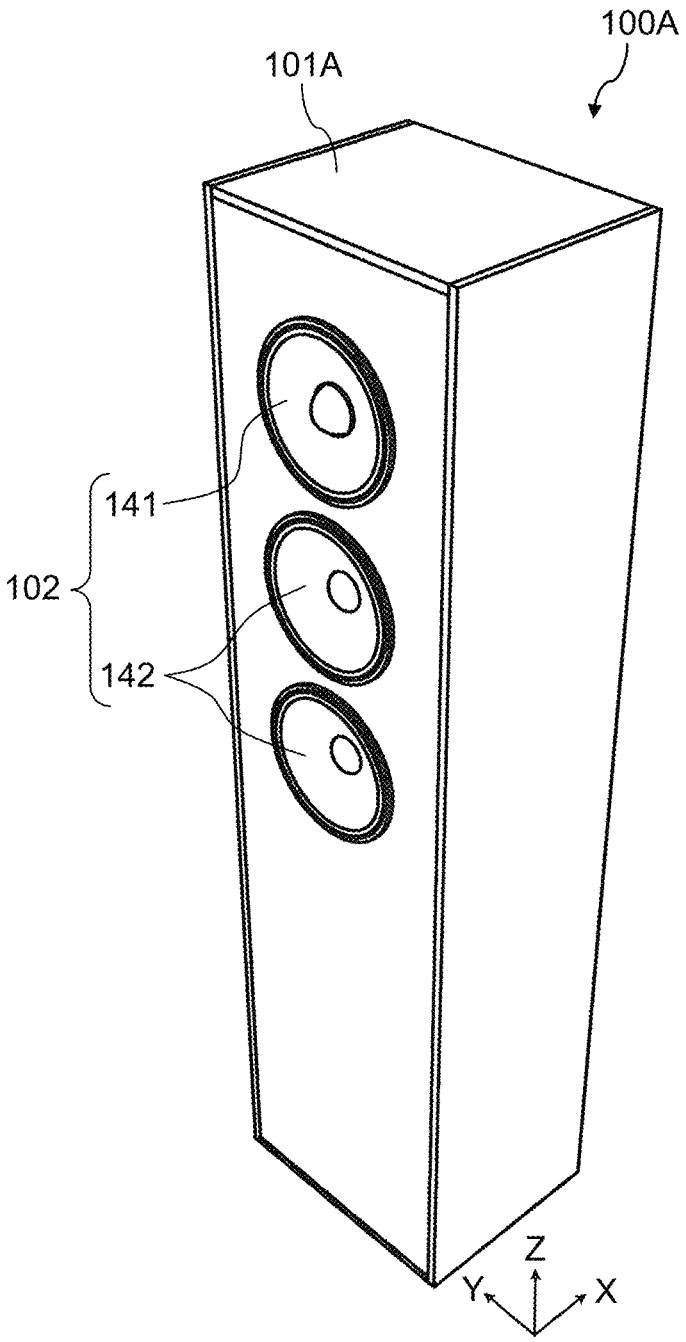
FIG. 8 is a perspective view schematically illustrating an example of an external appearance of a speaker device according to a second exemplary embodiment.

FIG. 8 is a perspective view schematically illustrating an example of an external appearance of speaker device 100A according to the second exemplary embodiment.

As shown in FIG. 8, speaker device 100A includes the plurality of loudspeakers 102 (e.g., three loudspeakers 102) in one cabinet 101A. Specifically, loudspeakers 102 mounted to speaker device 100A are first loudspeaker 141 and two second loudspeakers 142. It is to be noted that loudspeakers 102 of speaker device 100A are not at all limited to three in number.

In the present exemplary embodiment, speaker device 100A is a bass-reflex speaker device. Speaker device 100A includes port 143 opening at a back face of speaker device 100A, and duct 144 connected to port 143 (refer to FIG. 11).

First loudspeaker 141 is, for example, a coaxial speaker that mainly generates sounds in a middle tone range and a high tone range.

Figure 9:
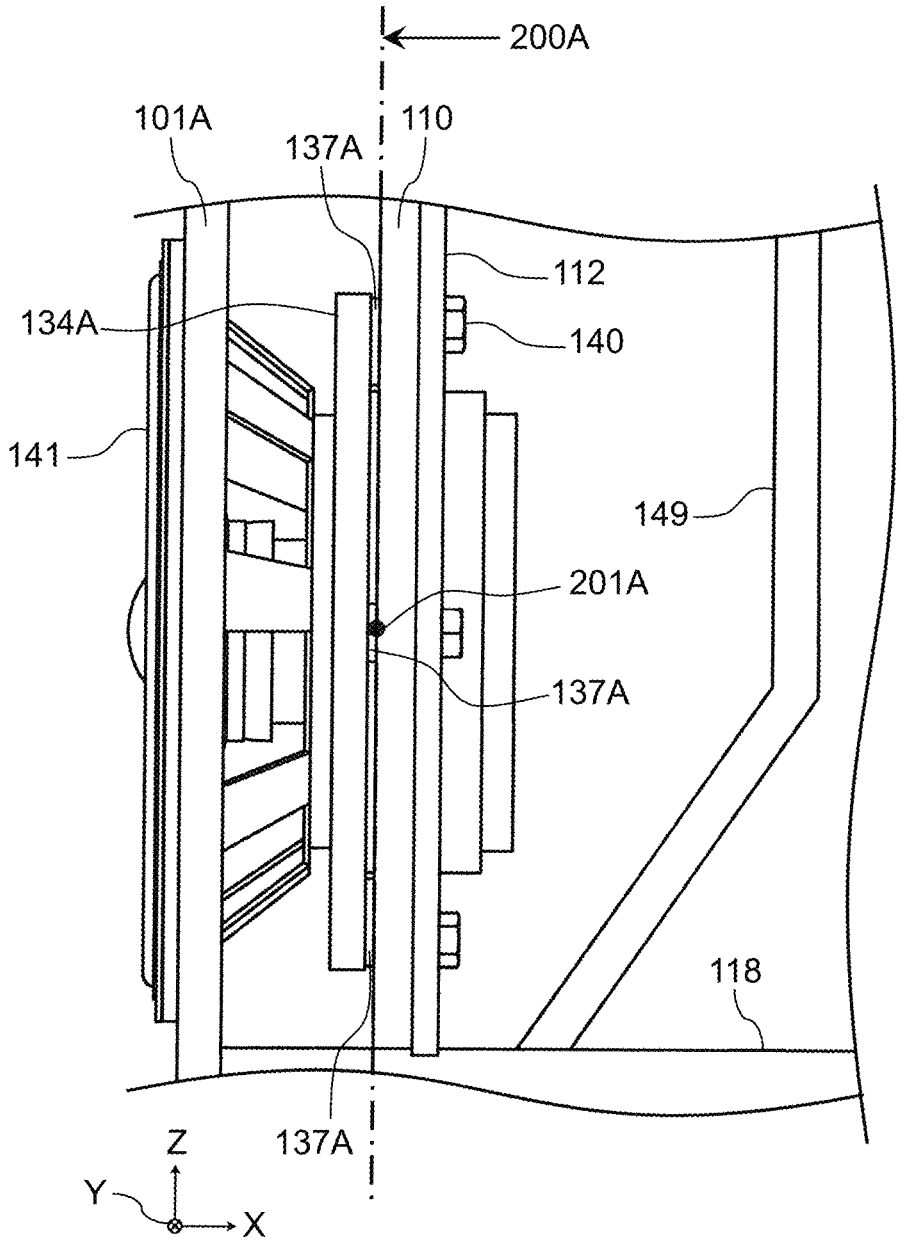
FIG. 9 is an enlarged side view illustrating a first loudspeaker and its periphery in a cabinet of the speaker device according to the second exemplary embodiment.

FIG. 9 is an enlarged side view illustrating first loudspeaker 141 and its periphery in cabinet 101A of speaker device 100A according to the second exemplary embodiment.

As shown in FIG. 9, first loudspeaker 141 is mounted to fixed part 112 (or specifically projection 110 of fixed part 112) via mounting member 134A. Mounting member 134A includes spacers 137A for adjustment of a position (of center of gravity 201A of first loudspeaker 141) where first loudspeaker 141 is mounted to fixed part 112. First loudspeaker 141 is mounted to fixed part 112 via spacers 137A.

Spacers 137A are each formed of, for example, a plate-shaped metal member of relatively high rigidity. Spacers 137A each have a through hole through which bolt 140 passes to mount first loudspeaker 141 to fixed part 112. It is preferable that spacers 137A be formed of a non-magnetic material such as stainless steel. In this way, influence of spacers 137A can be suppressed on a magnetic field of field portion 120 (refer to FIG. 2). Spacers 137A may be formed integrally with mounting member 134A. For example, spacers 137A may be fixed to mounting member 134A by an epoxy adhesive or may be fastened firmly to mounting member 134A by screws. This structure can suppress sliding of spacers 137A at its surface in contact with mounting member 134A during vibration of first loudspeaker 141.

Spacers 137A are disposed in respective positions (e.g., four positions in a structural example shown in the present exemplary embodiment) where bolts 140 are respectively mounted. It is to be noted that bolts 140 are members that fix mounting member 134A to fixed part 112. A plane including respective outer surfaces of spacers 137A is mounting plane 200A of mounting member 134A (a plane where mounting member 134A makes contact with projection 110 of fixed part 112). In order for mounting plane 200A of mounting member 134A to include center of gravity 201A of first loudspeaker 141, the position where first loudspeaker 141 is mounted to fixed part 112 is adjusted by means of, for example, spacers 137A in speaker device 100A.

Second loudspeakers 142 are each, for example, a so-called woofer that mainly generates sound in a low tone range as compared with first loudspeaker 141.

Figure 10:
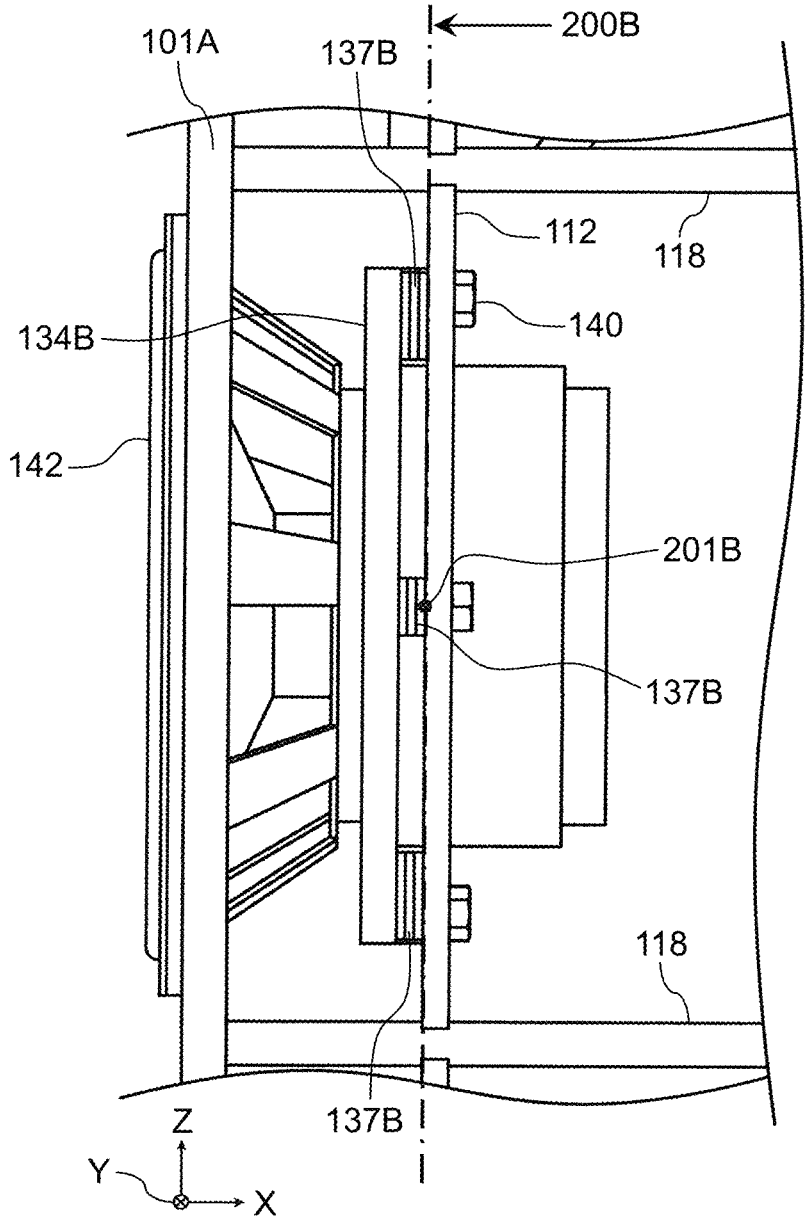
FIG. 10 is an enlarged side view illustrating a second loudspeaker and its periphery in the cabinet of the speaker device according to the second exemplary embodiment.

FIG. 10 is an enlarged side view illustrating second loudspeaker 142 and its periphery in cabinet 101A of speaker device 100A according to the second exemplary embodiment.

As shown in FIG. 10, second loudspeaker 142 is mounted to fixed part 112 via mounting members 134B. Mounting member 134B includes a plurality of spacers 137B for adjustment of a position (of center of gravity 201B of second loudspeaker 142) where second loudspeaker 142 is mounted to fixed part 112. Second loudspeaker 142 is mounted to fixed part 112 via the plurality of spacers 137B.

In the present exemplary embodiment, positions where bolts 140 are respectively mounted (e.g., four positions in a structural example shown in the present exemplary embodiment) each have spacers 137B that are stacked one on another. It is to be noted that bolts 140 are members that fix mounting member 134B to fixed part 112. A plane including an outer surface of outermost spacer 137B among spacers 137B that are stacked one on another is mounting plane 200B of mounting member 134B (a plane where mounting member 134B makes contact with fixed part 112). In order for mounting plane 200B of mounting member 134B to include center of gravity 201B of second loudspeaker 142, the position where second loudspeaker 142 is mounted to fixed part 112 in speaker device 100A is adjusted by means of spacers 137B that are stacked one on another. In speaker device 100A, spacers 137B are stacked one on another (that is to say, spacers 137B to be stacked one on another are adjusted in number), so that the adjustment of the mounting position of second loudspeaker 142 with respect to fixed part 112 can be effected, and center of gravity 201B of second loudspeaker 142 can be disposed in mounting plane 200B of mounting member 134B.

It is to be noted that spacer 137A and spacer 137B that are used to respectively mount first loudspeaker 141 and second loudspeaker 142 may be of substantially the same shape (identical components of the same shape). In this way, speaker device 100A can use a reduced number of component types.

Figure 11:
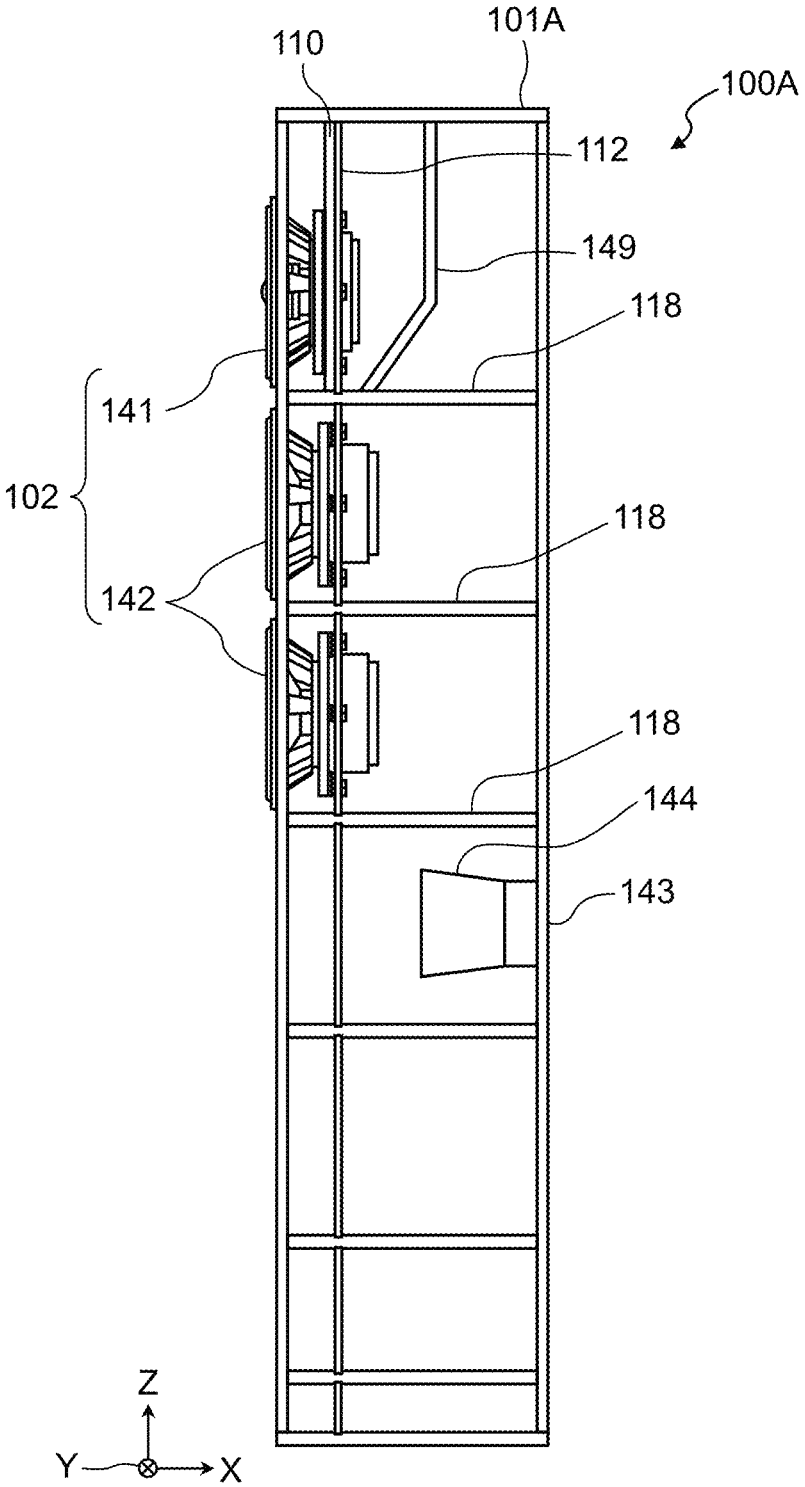
FIG. 11 is a side view schematically illustrating a structural example of a cabinet interior of the speaker device according to the second exemplary embodiment.

FIG. 11 is a side view schematically illustrating a structural example of an interior of cabinet 101A of speaker device 100A according to the second exemplary embodiment.

As shown in FIG. 11, cabinet 101A has a plurality of transverse plates 118. Each of the plurality of transverse plates 118 is fixedly disposed in cabinet 101A to be substantially parallel to a horizontal plane (a plane parallel to a surface on which speaker device 100A is placed: an X-Y plane).

In speaker device 100A, fixed parts 112 are respectively provided for loudspeakers 102. The plurality of fixed parts 112 are mounted in cabinet 101A while being respectively fitted in grooves that are respectively provided in transverse plates 118. The plurality of fixed parts 112 are disposed in a common vertical plane (Y-Z plane) and are each fixed, via transverse plate(s) 118 or directly, to cabinet 101A.

It is to be noted that each of transverse plates 118 is provided with at least one vertically through hole (not shown) (along the Z-axis). This enables vertical (Z-axis) transmission of air vibration in speaker device 100A.

With speaker device 100A having such a structure, cabinet 101A and speaker device 100A as a whole can have improved structural strengths, respectively. As such, entire cabinet 101A of speaker device 100A can reliably receive vibration of second loudspeaker 142 for the low tone range, and first loudspeaker 141 can be under suppressed influence of this vibration.

Fixed part 112 to which first loudspeaker 141 is mounted includes projection 110 that projects from a position where fixed part 112 is fixed to transverse plate 118 or cabinet 101A and reaches mounting plane 200A (a plane where projection 110 makes contact with mounting member 134A). In the present exemplary embodiment, projection 110 may be formed integrally with fixed part 112. With projection 110 provided in speaker device 100A, first loudspeaker 141 and second loudspeaker 142 that are structurally different from each other can have their respective diaphragms 121 (refer to FIG. 2) positioned substantially in a common surface (a front face of cabinet 101A in the present exemplary embodiment). Moreover, first loudspeaker 141 can have its center of gravity 201A disposed in mounting plane 200A, and second loudspeakers 142 can have their respective centers of gravity 201B disposed in mounting plane 200B. In this way, respective centers of gravity 201 (center of gravity 201A and centers of gravity 201B) of loudspeakers 102 can all be positioned in corresponding mounting planes 200A, 200B in speaker device 100A. In speaker device 100A, fixed parts 112 are disposed in the common vertical plane (Y-Z plane) for the ensured structural strength of cabinet 101A, and respective diaphragms 121 of loudspeakers 102 (first loudspeaker 141 and second loudspeakers 142) are positioned in the common surface, thus enabling suppressed phase shifts in sound.

In the present exemplary embodiment, it is to be noted that as shown in FIG. 11, a rearward part of first loudspeaker 141 may be enclosed by cabinet 101A, transverse plate 118, and partition wall 149. With cabinet 101A of speaker device 100A having such a structural interior, a rear face of first loudspeaker 141 can be under suppressed influence of air vibration that takes place rearwardly of second loudspeakers 142.

[2-2. Effects and Others]

As described above, the speaker device according to the present exemplary embodiment includes: the loudspeakers each including the diaphragm and the field portion disposed rearwardly of the diaphragm; and the cabinet accommodating the field portions. In this speaker device, each of the loudspeakers further includes the mounting member with which the loudspeaker is mounted to the cabinet, and the mounting plane of the mounting member includes the center of gravity of the loudspeaker.

It is to be noted that speaker device 100A is an example of the speaker device. Each of Loudspeakers 102, first loudspeaker 141, and second loudspeaker 142 is an example of the loudspeaker. Cabinet 101A is an example of the cabinet. Each of mounting members 134A and 134B is an example of the mounting member. Each of centers of gravity 201A and 201B is an example of the center of gravity of the loudspeaker. Each of mounting planes 200A and 200B is an example of the mounting plane.

With thus formed speaker device 100A, for example, effects similar to the effects of speaker device 100 described in the first exemplary embodiment can be obtained.

In the speaker device, the mounting member may include a spacer that is formed integrally with the mounting member. The loudspeaker may be mounted to the fixed part via the spacer.

It is to be noted that each of spacers 137A and 137B is an example of the spacer. Fixed part 112 is an example of the fixed part.

In thus formed speaker device 100A, for example, the position where first loudspeaker 141 is mounted to fixed part 112 can be adjusted by means of spacers 137A, so that center of gravity 201A of first loudspeaker 141 can be positioned in mounting plane 200A of mounting member 134A. Moreover, the position where second loudspeaker 142 is mounted to fixed part 112 can be adjusted by means of spacers 137B, so that center of gravity 201B of second loudspeaker 142 can be positioned in mounting plane 200B of mounting member 134B.

In the speaker device, the cabinet may be mounted with the plurality of loudspeakers, and the fixed parts may be fixed to the cabinet in a common plane.

It is to be noted that the plurality of loudspeakers 102 (first loudspeaker 141 and second loudspeakers 142) is an example of the plurality of loudspeakers.

With thus formed speaker device 100A, for example, cabinet 101A including the plurality of loudspeakers 102, and speaker device 100A as a whole can have the improved structural strengths, respectively. As such, entire cabinet 101A of speaker device 100A can reliably receive vibration of second loudspeaker 142 for the low tone range, and first loudspeaker 141 can be under suppressed influence of this vibration.

In the speaker device, the fixed parts may be respectively provided for the loudspeakers.

In the speaker device, the fixed part may include a projection that protrusively reaches the mounting plane.

Projection 110 protrusively reaching mounting plane 200A is an example of the projection.

In thus formed speaker device 100A, for example, first loudspeaker 141 and second loudspeaker 142 that are structurally different from each other can have their respective diaphragms 121 positioned substantially in the common surface (e.g., the front face of cabinet 101A) to suppress phase shifts in sound. Moreover, first loudspeaker 141 can have its center of gravity 201A disposed in mounting plane 200A, and second loudspeakers 142 can have their respective centers of gravity 201B disposed in mounting plane 200B.

Other Exemplary Embodiments

The first and second exemplary embodiments have been described above as being illustrative of the technique disclosed in the present application. However, the above exemplary embodiments are not restrictive of the present disclosure. For example, other exemplary embodiments that are realized by combining the constituent elements of choice that are described in this description or omitting some of the constituent elements may also be exemplary embodiments of the present disclosure. Also included in the present disclosure are modifications that are obtained by making to the above exemplary embodiments various changes that may be conceived of by those skilled in the art without departing from the spirit of the present disclosure, that is to say, the meaning of the recitations in the claim.

Accordingly, some other exemplary embodiments are described below.

The speaker device of the present disclosure is applicable to those including an electronic device and a mobile body.

A brief description is provided of an example of the electronic device, which is one example of the application of the present disclosure's speaker device.

Figure 12:
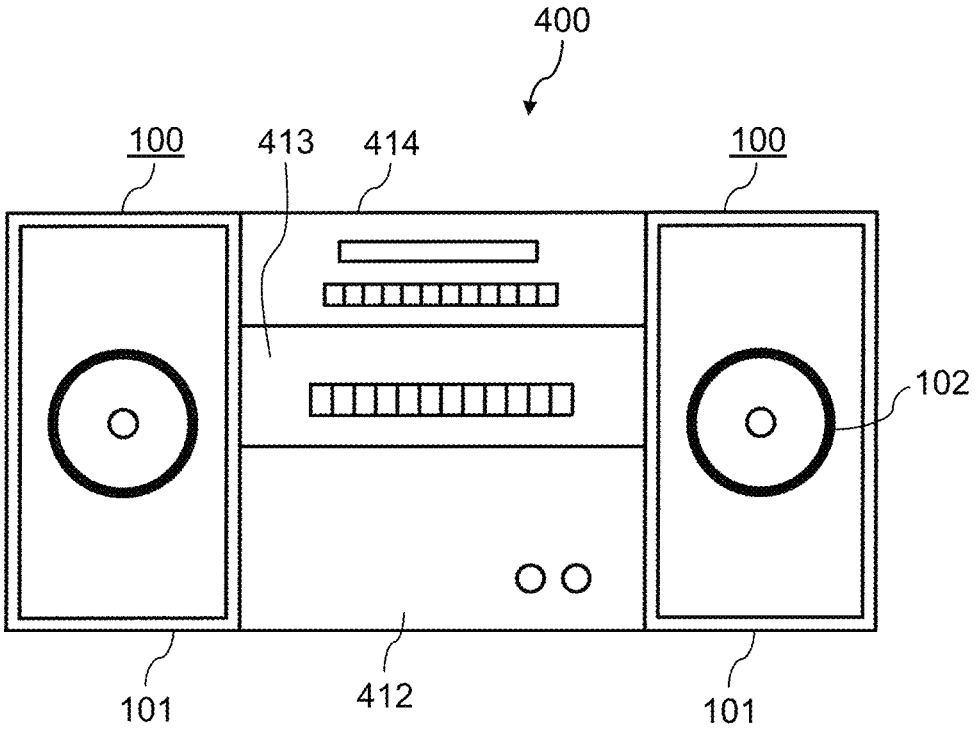
FIG. 12 schematically illustrates an example of an external appearance of an electronic device including the speaker devices of the first exemplary embodiment.

FIG. 12 schematically illustrates an example of external appearance of electronic device 400 including speaker devices 100 of the first exemplary embodiment.

Electronic device 400 is, for example, an audio component system.

Electronic device 400 includes a pair of left and right speaker devices 100 described in the first exemplary embodiment. Also included by electronic device 400 are: amplifier 412 including a circuit that amplifies an electrical signal to be input into speaker device 100; and tuner 413 and compact disc (CD) player 414 that output an audio signal to be input into amplifier 412.

In electronic device 400 as the audio component system, the audio signal output from tuner 413 or CD player 414 is amplified by amplifier 412, and sound corresponding to this audio signal is emitted from loudspeaker 102 included in speaker device 100. Specifically, in loudspeaker 102, dynamic magnetic force generated by voice coil body 125 in response to the electrical signal input to voice coil body 125 interacts with static magnetic force generated in the magnetic gap, whereby voice coil body 125 vibrates relative to frame 122. This vibration is transmitted to diaphragm 121, thus causing diaphragm 121 to vibrate and generate sound.

Electronic device 400 that can be achieved using this structure is thus capable of reproducing, as described above, clear sound with less distortion.

It is to be noted that electronic device 400 may include, in place of speaker devices 100, speaker devices 100A described the second exemplary embodiment.

Electronic device 400, namely, the audio component system including speaker devices 100 (or speaker devices 100A) that have loudspeakers 102 has been described here, as an application example of the speaker devices disclosed in the present disclosure to the electronic device. However, the present disclosure is not at all limited to this structure. The speaker device of the present disclosure is also applicable to, for example, mobile telephones and portable audio devices. Moreover, the speaker device of the present disclosure is susceptible of wide application or extension, such as for use in video devices that include liquid crystal televisions, plasma display televisions, and organic electroluminescence (EL) televisions, information communication devices that include the mobile telephones, and electronic devices that include computer-related devices.

A brief description is provided next of a structural example in which the speaker device of the present disclosure is applied to the mobile body.

Figure 13:
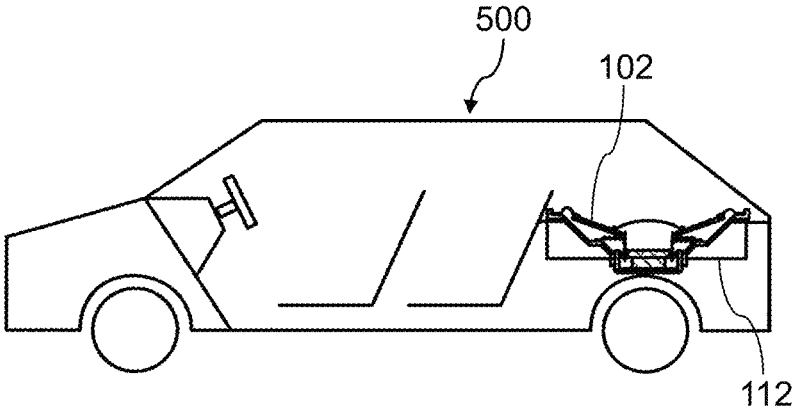
FIG. 13 is a sectional view schematically illustrating an example of a mobile body including the loudspeaker of the first exemplary embodiment.

FIG. 13 is a sectional view schematically illustrating an example of mobile body 500 including loudspeaker 102 of the first exemplary embodiment.

Mobile body 500 is, for example, an automobile.

As shown in FIG. 13, a rear tray of mobile body 500 can function as a part of cabinet 101. Alternatively, a front panel (not shown) of mobile body 500 can function as a part of cabinet 101.

In the example shown in FIG. 13, with the mounting plane passing center of gravity 201 (not shown in FIG. 13), loudspeaker 102 is fixed to fixed part 112 that is fixed to the rear tray of mobile body 500. Based on an audio signal that is sent from a car navigation system (not shown) or a car audio system (not shown) that are mounted on mobile body 500, loudspeaker 102 emits sound in mobile body 500.

Even in cases where vibration is caused to mobile body 500, fixing of speaker device 100 (this reference mark is not shown in FIG. 13) thus mounted to mobile body 500 is stable with respect to the rear tray or the like, so that stable sound reproduction can be achieved.

It is to be noted that mobile body 500 is not limited to the automobile and may be an aircraft, a watercraft, or a train.

While it is only fixed part 112 mounted with first loudspeaker 141 that includes projection 110 in the structure described in the second exemplary embodiment, the present disclosure is not at all limited to this structure. For example, fixed parts 112 that are respectively mounted with first loudspeaker 141 and second loudspeaker 142 may be of the same shape, each having projection 110, and fixed part 112 to be mounted with first loudspeaker 141 may be disposed in cabinet 101A so that its surface provided with projection 110 faces first loudspeaker 141, while fixed part 112 to be mounted with second loudspeaker 142 may be disposed in cabinet 101A so that its surface without projection 110 faces second loudspeaker 142. Because respective fixed parts 112 can substantially be of the same shape, speaker device 100A can use a reduced number of component types.

The exemplary embodiments have been described above as being illustrative of the technique of the present disclosure, and the accompanying drawings and the detailed description have been provided accordingly.

For illustration of the above technique, the constituent elements illustrated and described in the accompanying drawings and the detailed description may include not only the constituent elements that are essential for solving the problems but also the constituent elements that are not essential for solving the problems. For this reason, those inessential constituent elements that are illustrated in the accompanying drawings or are described in the detailed description should not immediately be acknowledged as essential.

Since the above exemplary embodiments are intended to be illustrative of the technique of the present disclosure, various modifications, replacements, additions, omissions, and others can be made within the scope of the claims or equivalents of the claims. In addition, new exemplary embodiments can be made by combining the constituent elements described in the exemplary embodiments.

INDUSTRIAL APPLICABILITY

The present disclosure is applicable to a speaker device. Specifically, the present disclosure is applicable to, for example, video devices such as televisions, audio devices such as audio systems, electronic devices such as information communication devices, and mobile bodies such as automobiles.

REFERENCE MARKS IN THE DRAWINGS

100, 100A: speaker device
101, 101A: cabinet
102: loudspeaker
110: projection
111: outer shell
112: fixed part
113: through hole
114: sealing member
115: passage hole
116: reinforcing plate
117: beam
118: transverse plate
120: field portion
121: diaphragm
122: frame
123: edge
124: damper
125: voice coil body
126: annulus
127: center cap
131: top plate
132: magnet
133: yoke
134, 134A, 134B: mounting member

135: internal thread
137A, 137B: spacer
136: magnetic gap
138: cylindrical part
139: disk
140: bolt
141: first loudspeaker
142: second loudspeaker
143: port
144: duct
149: partition wall
200, 200A, 200B: mounting plane
201, 201A, 201B: center of gravity
400: electronic device
412: amplifier
413: tuner
414: player
500: mobile body

The invention claimed is:

1. A speaker device comprising:

a loudspeaker including a diaphragm and a field portion disposed rearwardly of the diaphragm; and a cabinet accommodating the field portion, wherein the loudspeaker further includes a mounting member with which the loudspeaker is mounted, and the cabinet further includes a fixed part to which the mounting member is mounted, the loudspeaker being mounted to the cabinet by the mounting member and the fixed part, the fixed part contacting an upper inner surface of the cabinet and a lower inner surface of the cabinet, the fixed part securing the mounting member to the cabinet, a mounting plane of the mounting member includes a center of gravity of the loudspeaker, and the mounting member is provided with a first through hole through which a part of the field portion is disposed.

2. The speaker device according to claim 1, wherein the cabinet includes a second through hole through which the loudspeaker is disposed, and the cabinet further includes a sealing member that has flexibility to seal between a periphery of the second through hole and an outer peripheral part of the loudspeaker.

3. The speaker device according to claim 1, wherein the mounting member is integral with a top plate of the loudspeaker.

4. The speaker device according to claim 3, wherein the mounting member is flush with the top plate at the mounting plane.

5. The speaker device according to claim 1, wherein the mounting member includes a spacer formed integrally with the mounting member, and the loudspeaker is mounted to the fixed part via the spacer.

6. The speaker device according to claim 1, wherein the cabinet is mounted with a plurality of the loudspeakers, and a plurality of the fixed parts are fixed to the cabinet in a common plane.

7. The speaker device according to claim 6, wherein the plurality of the fixed parts are respectively provided for the plurality of the loudspeakers.

8. The speaker device according to claim 1, wherein the fixed part includes a projection that protrusively reaches the mounting plane.

9. The speaker device according to claim 1, wherein the field portion includes a top plate, a magnet and a yoke.

10. The speaker device according to claim 1, wherein the fixed part contacts a first inner side surface of the cabinet and a second inner side surface of the cabinet, the first inner side surface of the cabinet being located opposite the second inner side surface of the cabinet.

11. The speaker device according to claim 1, wherein the fixed part has passage holes formed therein which allow for the passage of sound.

* * * * *